United States Patent [19]

Gimenez et al.

[11] Patent Number: 4,692,226

[45] Date of Patent: Sep. 8, 1987

[54] PROCESS TO MANUFACTURE GLYOXYLIC ACID BY ELECTROCHEMICAL REDUCTION OF OXALIC ACID

[75] Inventors: Isabelle Gimenez; Marie-Jeanne Barbier, both of Grenoble; Suzanne Maximovitch, Meylan; Yani Christidis, Paris, all of France

[73] Assignee: Societe Francaise Hoechst, Puteaux, France

[21] Appl. No.: 901,792

[22] Filed: Aug. 29, 1986

[30] Foreign Application Priority Data

Sep. 10, 1985 [FR] France ..... 85 13385

[51] Int. Cl.[4] ..... C07B 29/06; C07C 51/40

[52] U.S. Cl. ..... 204/73 R; 204/72; 204/74; 204/75; 204/76

[58] Field of Search ..... 204/76, 75, 74, 72, 204/73 R, 59 R

[56] References Cited

U.S. PATENT DOCUMENTS 798,920 9/1905 Von Porthem ..... 204/76
1,227,706 5/1917 Vaygoony ..... 204/76
3,779,875 12/1973 Michelet ..... 204/76
3,779,876 12/1973 Michelet ..... 204/76
3,929,613 12/1975 Michelet ..... 204/76

FOREIGN PATENT DOCUMENTS 753050 8/1932 France ..... 204/76

OTHER PUBLICATIONS

Baizer, Organic Electrochemistry; M. Dekker Inc., New York, N.Y.; 1973, pp. 196–207.

*Primary Examiner*—Arthur P. Demers
*Attorney, Agent, or Firm*—Browdy and Neimark

[57] ABSTRACT

This process, carried out at a temperature of 0° to 30° C. in an electrolyzer outfit consisting of at least one anode compartment containing an anode and anolyte, comprising an aqueous acid solution, at least one cathode compartment containing a cathode and catholyte, comprising an aqueous solution of oxalic acid and, between the two compartments, at least one separator, is characterized by the fact that the anode is made of a solid conductor uniformly coated with lead dioxide.

7 Claims, No Drawings

PROCESS TO MANUFACTURE GLYOXYLIC ACID BY ELECTROCHEMICAL REDUCTION OF OXALIC ACID

This invention concerns a process to manufacture glyoxylic acid by electrochemic reduction of oxalic acid.

Glyoxylic acid is a synthetic industrial basic petrochemical commonly used to produce feedstocks such as p-hydroxymandelic acid and p-hydroxyphenylglycine. It is mainly obtained by controlled oxidation of glyoxal or by electrochemic reduction of oxalic acid.

The electrochemical reduction of oxalic acid to glyoxylic acid has been known for a long time and is generally carried out in an acid medium, at low temperature, with very high overvoltage hydrogen electrodes, sometimes in the presence of a protonic mineral acid such as sulphuric acid, with an ion-exchanger membrane. The electrolyte is generally kept circulating (German Pat. Nos. 163.842, 194.038, 204.787, 210.693, 292.866, 347.605, 458.436; French Pat. Nos. 2.062.822, 2.151.150; Indian Pat. No. 148.412; W. MOHRSCHULZ, Z. Elektrochem. 1926, 82, 449; S. AVERY et al. Ber. 1899, 32, 2233—38; E. BAUR, Z. Elektrochem. 1919, 25, 104–5). In these long-term industrial operations, the processes described previously do not give entire satisfaction. Very often, there is either a gradual drop in the electric yield (see German Pat. No. 347.605, H.D.C. RARSON et al, J. Appl. Chem., 1963, 13, 233–9), or an increasingly higher production of hydrogen at the cathode, or rapid consumption of the anode.

In order to prevent these drawbacks, it was suggested carrying out reduction either in the presence of a tertiary amine or a quaternary ammonium (French Pat. Nos. 2.151.151, 2.208.876) or by carefully controlling the temperature of the catholyte (Japanese patent application No. 55-58380). However, these solutions do not prevent gradual destruction of the anode.

The Applicant, however, was surprised to discover a simple, economic process for the electrochemical reduction of oxalic acid to glyoxylic acid, which eliminates this drawback. The process, carried out at a temperature of 0° C. to 30° C., in an electrolyzer outfit consisting of at least one anode compartment, containing an anode and anolyte and one cathode compartment, containing a cathode and a catholyte consisting of an aqueous solution of oxalic acid and, between the two compartments, at least one separator, is characterized by the fact that the anode consists of a solid conductor uniformly coated with lead dioxide.

According to the invention process, the lead dioxide coating is uniform, compact and adheres to the substrate with a thickness of 0.2 to 5 mm. In order to facilitate adherence, it is sometimes worthwhile putting a thin metal buffer coat between the substrate and the lead dioxide coating, made of copper, silver or gold.

The load dioxide coating is made by already established methods. For example, it can be obtained by an electrolytic deposit on the solid conductor, which has been cleaned beforehand, in an electrolyzer outfit, consisting of a copper cathode, containing an electrolyte made up of an acidic aqueous solution of lead nitrate (II) and copper nitrate (II), kept at a pH=2 by adding copper carbonate (II) and lead oxide (II) with a current density in the order of 30 to 50 mA/cm$^2$ and a temperature of about 60° C.

The uniformity of the deposit, as well as its adherence, compactness and thickness, which is easily regulated by the duration of the electrolytic deposit, are easily controlled by observing the surface of the deposit and the edge after breaking the electrode, with a scanning electron microscope.

An X-ray analysis of the structure shows that it mainly consists of B-crystallized lead dioxide.

The solid conductor is chosen from among materials commonly used in electromechanical processes, such as lead and lead alloys, compact graphite, vitreous carbon, titanium, gold and platinum. The best choice is compact graphite or titanium, with preference given to titanium.

The cathode is made of lead or one of its alloys, preferably bismuth.

The anode and cathode can be in various forms, such as plates, disks or grids. They can either have a compact structure or be porous and gas permeable. Preferably, the anode and cathode should have a gas permeable structure.

The process used in the invention takes place at a temperature of 0° C. to 30° C., which very often means cooling the cell and/or the anolyte and catholyte.

The anolyte consists of an aqueous acid solution.

The exact nature of the anolyte is not a special feature of the invention since its main aim is to ensure electrical conductivity between the two electrodes. Aqueous solutions of sulphuric or phosphoric acid are usually used. The concentration of these solutions is generally between 0.1 and 5 moles/liter, preferably between 0.5 and 2 moles/liter.

The catholyte, at the begining of electrolysis, is an aqueous solution of oxalic acid with a concentration between 0.1M and its saturation at the temperature considered. The concentration of the sulphuric acid in the anolyte is preferably 1M. During electrolysis, the concentration of the oxalic acid and glyoxylic acid produced can be constant when operation is continuous and variable when operation is discontinuous. Advantageously, the concentration of the oxalic acid in the catholyte is 0.7±0.1M. When operation is discontinuous, it is best to regularly add oxalic acid to the catholyte in order to maintain its concentration as close as possible to this figure. Glyoxylic acid reduces very easily. The eddy reduction current of glyoxylic acid is proportional to its concentration in the reactive medium. In order to prevent possible electrochemical reduction of the glyoxylic acid produced, it is best to limit the conversion rate of the oxalic acid used to about 60% in molar ratios.

When operation is discontinuous, it is therefore best to stop reduction when the conversion rate is attained, then separate the glyoxylic acid produced from the residual oxalic acid by already established methods, such as selective fixation of oxalic acid, using an ion exchange resin, followed by recovery of the aqueous solution of glyoxylic acid exempt of any other mineral and/or organic acid which can, if necessary, be concentrated in order to obtain a commercial aqueous solution of 50 wt % glyoxylic acid. When continuous operation is used, the glyoxalic acid produced is continuously extracted using already established methods, and an equivalent amount of fresh oxalic acid is simultaneously added.

The process used in the invention is carried out in an electrolyzer outfit with at least one separating membrane inserted between at least one anode compartment and one cathode compartment. The membrane is an ion exchanging membrane, preferably a cation exchanging membrane. The type of membrane is not a particular feature of the invention and any kind of membrane can be used, especially membranes of the homogenous type and membranes of the heterogenous type. The perm selectivity of the membranes used is preferably greater than 60% (determined according to French Pat. No. 1.584.187). Preferably, the anode and cathode, which have a gas permeable structure, are plated to either side of the separating membrane. The current density at the cathode is generally between 3 and 50 A/dm$^2$.

Evacuation of the gases produced both at the cathode and anode is facilitated by upward circulation of the anolyte and catholyte along the respective electrodes. Preferably, the anolyte can be made to flow faster than the catholyte. The electrolytic cell can also have a total anode surface area greater than that of the cathode, preferably about 20% more.

The following examples are given non-restrictively and do not in any way limit the invention.

EXAMPLE 1

A—Preparation of the anode

A disk of 2239 quality graphite manufactured by LE CARBONE-LORRAINE, with a geometric surface area of 12.5 cm$^2$, is carefully cleaned by anodic polarization for 30 minutes in 10% wt sodium carbonate with a current density in the order of 4 mA/cm$^2$. After washing with distilled water, it is placed in a 10 wt % aqueous solution of nitric acid for 10 minutes and washed again with distilled water.

The disk is then used as the central anode in an electrolyzer outfit which has two lateral copper cathodes and an electrolyte consisting of an aqueous acid solution (pH=4 to 4.5), containing 325 to 350 g/l of lead nitrate (II) and 25 to 30 g/l of copper nitrate (II), kept circulating at a temperature of about 60° C. The lead dioxide deposit is formed on the anode at a current density of 30 to 50 mA/cm$^2$, at 60±5° C. The pH of the electrolyte is kept at about 2 by adding lead oxide (II) and copper carbonate (II). The electrolysis is stopped when the thickness of the lead dioxide deposited on the anode is about 0.4 mm. The deposit is examined under a scanning electron microscope to check that it is uniform, compact and adheres to the substrate and that it consists of pyramidal grains with salient faces.

B—Electrochemical reduction of oxalic acid

In a laboratory electrolyzer outfit, consisting of a plane cathode disk made of 99.99% pure lead, with a surface area of 12.5 cm$^2$, a graphite anode coated with lead dioxide prepared as above, a "Nafion" membrane (Kirk-Othmer, Encyclopedia of Chemical Technology, Volume 15, page 120, 3rd edition, 1981, J. WILEY and Sons, New York), separating a cathode compartment and an anode compartment, an auxiliary pumping system which ensures continuous upward circulation of the catholyte and anolyte along the electrodes at a regulated temperature, and a d.c. power supply, the following is placed:

1 liter of an aqueous solution of 0.71M oxalic acid as the catholyte;

1 liter of an aqueous solution of 1M of sulphuric acid as the anolyte.

Electrolysis is started up at 20±1° C., with a voltage of 8 volts, a current density of 100 mA/cm$^2$ and a catholyte and anolyte circulation of 400 cm$^3$/min, kept at 20±1° C.

After 6 hours of operation, 84 mmoles of oxalic acid are dissolved in the catholyte. After 12 hours operation, 119 mmoles are added, after 24 hours, 367 mmoles, and after 30 hours, 125 mmoles.

After 36 hours of operation and a consumption of 162 000 coulombs and 0.79 moles of oxalic acid, a catholyte is obtained containing 0.615 moles of oxalic acid and 0.685 moles of glyoxylic acid. The chemical yield is 86.7% of the theoretical value calculated with respect to the oxalic acid consumed and the electric efficiency is 81.6% of the theoretical value calculated with respect to the glyoxylic acid produced. The anode and cathode do not show any corrosion or loss of weight.

EXAMPLE 2

A—Preparing the anode

A plate of 99.6% pure titanium, 0.25 mm thick, is used as a grid with identical mesh 3-34-25. Then the grid is carefully sanded and rinsed with acetone, alcohol and water, and uniformly coated with lead oxide, using the process described in 1-A. The active surface area, determined by electrochemical control after the deposit has formed, is 9 cm$^2$.

B—Electrochemical reduction of oxalic acid

In a laboratory electrolyzer outfit with a 99.99% pure lead cathode in the form of a grid with an active surface area of 9 cm$^2$, a titanium anode coated with lead dioxide prepared as above, a "Nafion" membrane on either side of which the two electrodes are plated, an auxiliary pumping system which ensures continuous upward circulation of the catholyte and anolyte along the electrodes at a regulated temperature, and a d.c. power supply, the following is placed:

1 liter of an aqueous solution of 0.653M oxalic acid as the catholyte;

1 liter of an aqueous solution of 1M of sulphuric acid as the anolyte.

Electrolysis is started up at 20±1° C., with a voltage of 8 volts, a current density of 100 mA/cm$^2$ and a catholyte and anolyte circulation of 400 cm$^3$/min, kept at 20±1° C.

After 21 hours of operation and a consumption of 68 040 coulombs, a catholyte is obtained containing 334 mmoles of oxalic acid and 227 mmoles of glyoxylic acid, i.e. a yield of 86.8% of the theoretical value with respect to the oxalic acid consumed and an electric efficiency of 78.6% of the theoretical value with respect to the glyoxylic acid produced. The anode and cathode do not show any corrosion or appreciable loss of weight. In the anolyte, only 1 ppm of lead is detected, which corresponds to a consumption of 0.004 mmoles of lead dioxide per Faraday.

COMPARATIVE EXAMPLES 3–5

EXAMPLE 3

Example 1-B is reproduced, replacing the lead dioxide coated compact graphite anode with a lead anode of similar shape. During electrolysis, a consumption of 1.64 mmoles of lead per Faraday is recorded for this anode.

EXAMPLE 4

Example 1-B is reproduced, replacing the lead dioxide coated compact graphite anode with a compact graphite anode of the same quality and shape. During electrolysis, a consumption of 341.3 mmoles of carbon per Faraday is recorded.

EXAMPLE 5

When example 2-B is reproduced, replacing the lead oxide coated titanium anode with a titanium anode of the same quality and shape, electrolysis quickly stops, due to the formation of an insulating layer of titanium oxide on the anode.

Naturally, this invention has been described in a purely non-restrictive manner and any relevant changes may be made without departing from its scope.

We claim:

1. A process for manufacturing glyoxylic acid by electrochemical reduction of oxalic acid at a temperature of from 0° to 30° C. in an electrolysis apparatus comprising:

at least one anode compartment containing an anode and an anolyte, the anolyte comprising an aqueous acid solution;

at least one cathode compartment containing a cathode and a catholyte, the catholyte comprising an aqueous solution of oxalic acid; and at least one separator between the two compartments;

wherein the anode consists of a solid conductor selected from the group consisting of compact graphite, vitreous carbon, titanium, gold, and platinum, the conductor being coated before use with an electrolytic deposit of a uniform layer of lead dioxide.

2. Process according to claim 1 in which the separator consists of an ion exchanging membrane.

3. Process according to claim 1 in which the separator consists of a cation exchanging membrane.

4. Process according to claim 1 in which the anode is made of lead dioxide coated titanium.

5. Process according to claim 1 in which the anode is made of lead dioxide coated compact graphite.

6. Process according to claim 1 in which the solid conductor has a gas permeable structure.

7. Process according to claim 2 in which the two electrodes are plated on either side of the ion exchanging membrane.

* * * * *